United States Patent [19]

Bruzek et al.

[11] Patent Number: 4,998,654

[45] Date of Patent: Mar. 12, 1991

[54] ARTICLE CARRIER VEST

[76] Inventors: Dana Bruzek, 3690 Togo Rd., Wayzata, Minn. 55391; Jesse L. Colodner, 22 Walter St., Pearl River, N.Y. 10965

[21] Appl. No.: 349,168

[22] Filed: May 8, 1989

[51] Int. Cl.[5] ..... A45F 3/00; A41B 3/14; A41D 1/04

[52] U.S. Cl. ..... 224/204; 224/205; 224/901; 2/102; 2/131; 2/DIG. 1

[58] Field of Search ..... 224/202, 204, 205, 206, 224/208, 209, 215, 231, 235, 257-260, 264, 901, 148; 2/94, 95, 102, 2.1 R, 131, DIG. 1, DIG. 3, 98; 128/202.14, 201.27; 272/119

[56] References Cited

U.S. PATENT DOCUMENTS

| | | | |
|---|---|---|---|
| 314,333 | 3/1885 | Heller | 2/94 X |
| 1,623,993 | 4/1927 | Anderson | 2/102 X |
| 2,620,479 | 12/1952 | Buck | 2/94 |
| 2,634,420 | 4/1953 | Jackson | 2/131 X |
| 2,678,447 | 5/1954 | Bracken | 2/94 |
| 2,738,909 | 3/1956 | Shadoin et al. | 224/202 |
| 2,948,899 | 8/1960 | Allen | 2/94 |
| 3,155,241 | 10/1963 | Allen | 2/94 |
| 3,193,842 | 7/1965 | Bell | 2/94 |
| 4,041,549 | 8/1977 | Atkinson | 2/94 |
| 4,079,467 | 3/1978 | Baldwin | 2/94 |
| 4,262,832 | 4/1981 | Perkins | 2/102 X |
| 4,369,526 | 11/1983 | Clutts | 2/94 X |
| 4,530,349 | 7/1985 | Metzger | 2/102 X |
| 4,600,134 | 7/1986 | Colby | 224/260 |
| 4,658,442 | 4/1987 | Tomlinson et al. | 2/94 |
| 4,796,304 | 1/1989 | Shelby | 2/94 |
| 4,811,768 | 3/1989 | Williams | 224/205 X |

FOREIGN PATENT DOCUMENTS

| | | | |
|---|---|---|---|
| 48861 | 3/1911 | Australia | 2/102 |
| 118979 | 12/1944 | Australia | 224/202 |

*Primary Examiner*—Ernest G. Cusick
*Assistant Examiner*—Robert M. Fetsuga
*Attorney, Agent, or Firm*—Iman Abdallah

[57] ABSTRACT

A unitary carrier vest for shoulder-supported carrying of packages and other articles. The vest includes two L-shaped carrier bags integrally formed with a flexible vest back portion formed by an array of flexible cross-hatching. The carrier bags are disposed to each side of the wearer's torso. The carrier vest further includes a padded, double-layered collar that permits the vest to be worn as a collared or collarless garment.

2 Claims, 2 Drawing Sheets

ARTICLE CARRIER VEST

BACKGROUND OF THE INVENTION

The present invention generally relates to shoulder-supported package and article carriers. More specifically, this invention relates to shoulder-supported carrier garments having carrier means disposed on each side of the torso.

SUMMARY OF THE INVENTION

An object of the present invention is to provide an article carrier that permits load carrying on each side of a user's torso.

Another object of this invention is to provide a shoulder-supported article carrier that comfortably distributes the carried load about the user's body.

A further object of the present invention is to provide an article carrier having flexible construction for adaptation to different body sizes.

It is also an object of the present invention to provide an article carrier formed as a unitary garment that can be easily folded for storage.

A still further object of this invention is to provide an article carrier that eliminates shoulder straps and related load bearing concentration.

In view of the foregoing objects, the article carrier of the present invention comprises a unitary carrier vest having dual, flaccid carrying bags disposed on each side of a user's torso, said carrier vest further including an integrally constructed, netted back portion providing back ventilation and flexible fitting means for different body shapes and sizes, a padded collar portion providing comfort to the neck of the user, and an adjustable front waist belt.

DESCRIPTION OF PREFERRED EMBODIMENT

Figure 1:
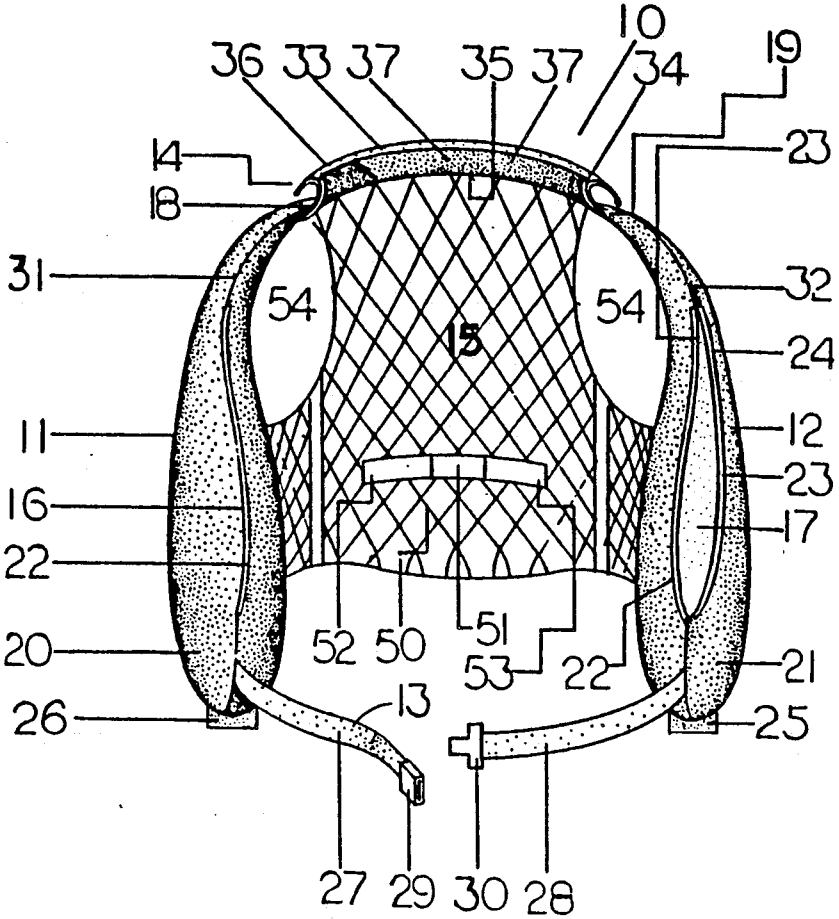
FIG. 1 is a front elevational view of the carrier vest described in the present invention.

FIG. 1 illustrates a front elevational view of the carrier vest 10 of the present invention. Carrier vest 10 comprises a unitary garment including dual carrier bags 11, 12, vest waist belt 13, vest collar portion 14 and vest back portion 15. Carrier bags 11, 12 are disposed in a manner to permit package or article carrying on each side of the user's torso. Carrier bags 11, 12 are formed of a flaccid material, preferably water-resistant, for example, waterproof ripstop nylon, having selectively closeable openings 16, 17 formed therein. Openings 16, 17 respectively extend vertically along the concavely curved top portions of bags 11, 12 from the upper top portions 31, 32 of carrier bags 11, 12 to the lower front portions 20, 21 of the substantially L-shaped carrier bags 11, 12. Openings 16, 17 are selectively closeable by operation of selective closure means 22, for example, velcro closures, the attaching portion 23 of said closure means 22 being disposed to one side of opening 17 and the receiving portion 24 of said closure means 22 being disposed to the opposite side of opening 17. In FIG. 1 carrier bag 11 is shown having closure means 22 in the closed position and carrier bag 12 is shown with closure means 22 in the open position for article receipt therein. Bottom portions 25, 26 of carrier bags 11, 12 (FIGS. 2 and 3) are substantially flat members constructed of flexible material, for example leicra, capable of stretching both vertically and horizontally within the plane of said bottom portions 25,26, such construction permitting carrier bags 11,12 to expand to prevent a tear or break therein thereby augmenting the storage capacity of bags 11,12.

Referring again to FIG. 1 it can be seen that vest waist belt 13 comprises two belt poritons 27,28, belt clip receipt portion 27 being fixedly attached at one end to the lower front portion 20 of carrier bag 11, and belt clip portion 28 being fixedly attached at one end to the lower front portion 21 of carrier bag 12. The free end of belt clip receipt portion 27 has a clip receptacle 29 attached thereto and the free end of belt clip portion 28 has clip 30 attached thereto, said clip receptacle 29 and clip 30 forming the cooperable attachment means for belt portions 27,28 of vest waist belt 13. Clip receptacle 29 is adjustably attached to the free end of belt clip receipt portion 27 to thereby permit adjustment of the length of belt clip receipt portion 27 and thusly the length of vest waist belt 13.

Vest collar portion 14 is fixedly attached to upper edges 18,19 of carrier bags 11,12. Vest collar portion 14 is a double-layered member having a rear collar layer 33 and front collar layer 34. The width of rear collar layer 33 extends beyond front collar layer 34. Carrier vest 10 may be worn with rear collar layer 33 folded outwardly to lay adjacent to the outer surface of vest back portion 15, or rear collar layer 33 may be folded inwardly over front collar layer 34 and worn adjacent to the neck of the user. Rear collar layer 33 is preferably constructed of a moisture absorbent material, for example, terry cloth towel material. Front collar layer 34 is disposed adjacent to the lower edge 35 of the inner surface of rear collar layer 33 extending across the length of rear collar layer 33 between carrier bags 11,12. Front collar layer 34 is formed of a solid elastic substance 7, for example, foam rubber, covered by cloth material 6 to provide resilient support for the neck of the user.

Figure 2:
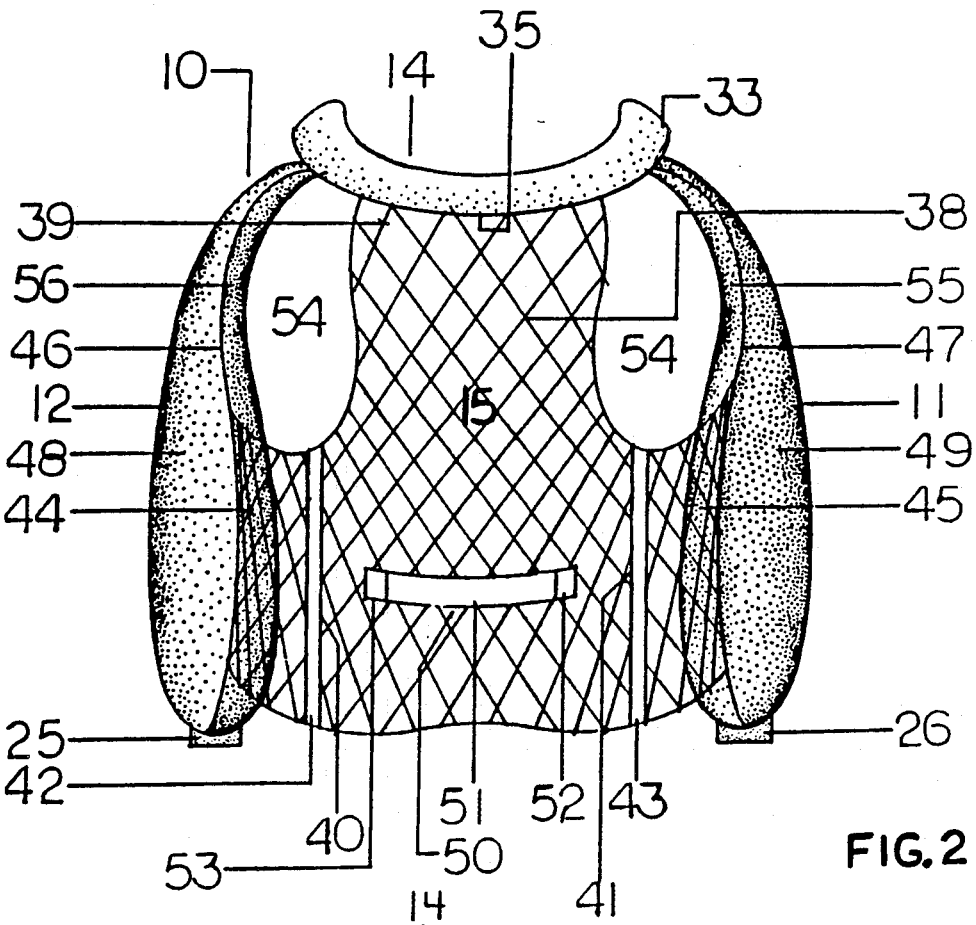
FIG. 2 is a rear elevational view of the present invention.

Referring now to FIG. 2, there is shown a rear elevational view of carrier vest 10 illustrating the construction of carrier vest back portion 15. Carrier vest back portion 15 is constructed of cross-hatched material, for example, cotton netting, to permit ventilation of the user's back. Netted construction of vest back portion 15 also permits use of carrier vest 10 by persons having different body sizes and shapes. The central portion 38 of vest back portion 15 is attached at its upper edge 39 to the lower edge 35 of rear collar layer 33, substantially at the middle portion of the rear collar layer 33. The vertical side edges 40,41 of central portion 38 at each side are attached to adjustment strips 42,43 which are preferably constructed of similar flexible material as bottom portions 25,26, for example, leicra. Peripheral portions 44,45 of vest back portion 15 extend from adjustment strips 42,43 to carrier bags 11,12. Peripheral vest back portions 44,45 are attached to carrier bags 11,12 at the vertical midlines 46,47 of the rear walls 48,49 of carrier bags 11,12. Adjustment of fit for the user is further facilitated by adjustable back strap 50 integrally constructed with vest back portion 15 to permit snug fitting of carrier vest 10 adjacent to the user's waist. Adjustable back strap 50 is disposed near the lower portion of the central portion 38 of vest back portion 15. Back strap 50, preferably formed of velcro for example, includes a strap tongue 51 and back strap receptor 52. Strap tongue 51 is fixedly attached to strap base 53 and selectively attaches to back strap receptor 52. Arm holes 54 are formed in vest back portion 15 adjacent to the upper rear portions 55,56 of carrier bags 11,12.

Figure 5:
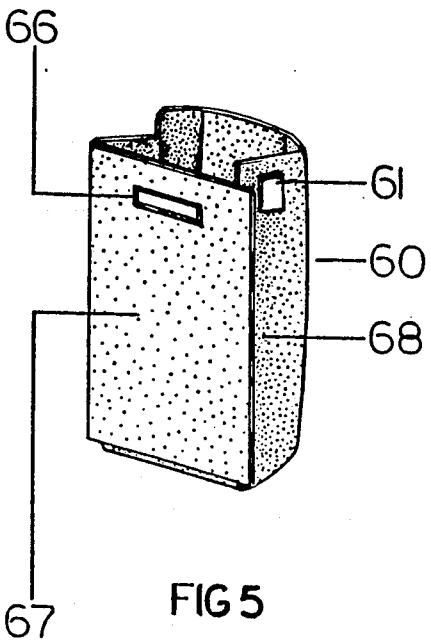
FIG. 5 is a rear perspective view of the pocket attachment disclosed in the present invention.
Figure 4:
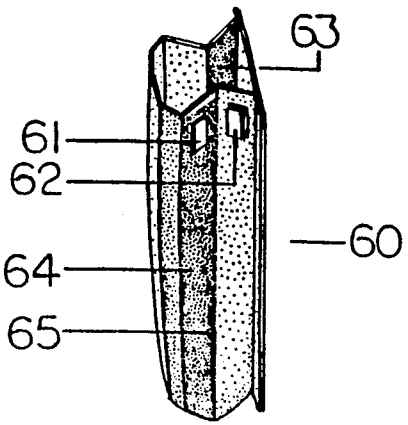
FIG. 4 is a side perspective view of the pocket attachment disclosed in the present invention.
Figure 3:
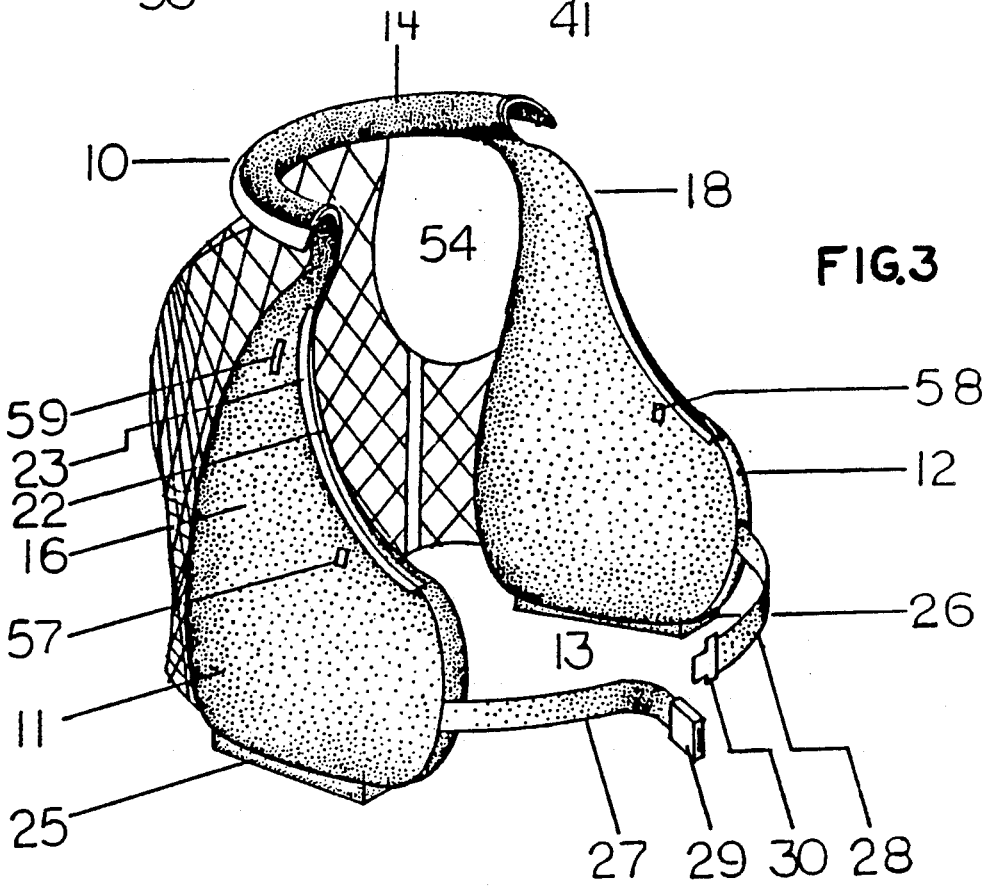
FIG. 3 is a side perspective view of the present invention.

In FIG. 3 which illustrates a side perspective view of the carrier vest 10 of the present invention, it can be best seen that the top portions of carrier bags 11,12 are concavely curved, forwardly extending to form substantially L-shaped carrier bags 11,12. Carrier bags 11,12 are integrally constructed at each end of vest collar portion 14. Supplemental closure means 57,58 are shown integrally attached respectively to the outer side wall of carrier bag 11 and the inner side wall of carrier bag 12, for cooperable engagement. Supplemental closure means 57,58, preferably velcro closures, are provided for use in conjunction with waist belt 13. Pocket attachment means 59 is shown disposed on the outer side wall of carrier bag 11 adjacent to attaching portion 23 of closure means 22 for attachment of removable pocket 60 (FIG. 4). FIGS. 4 and 5 respectively illustrate side and rear perspective views of removable pocket 60. Pocket 60 is provided for placement of small articles desired to be separated and is constructed of similar material as bags 11,12. Pocket 60 includes pocket closure means 61,62, preferably formed of velcro material, disposed proximate to the pocket mouth 63 along the side wall 64 of pocket 60. Pocket side wall 64 is formed in a manner to collapse along fold-line 65 to permit pocket closures means 61,62 to be attached to one another, thereby closing the mouth 63 of pocket 60. Each side wall 64 of pocket 61 includes a fold-line 65 formed therein. As shown in FIG. 5, a pocket attachment clip 66 is integrally constructed on the rear surface 67 of pocket base 68 for cooperable engagement with the pocket attachment means 59 (FIG. 3) of carrier bag 11 for attachment thereto.

While a particular preferred embodiment of the present invention has been disclosed, changes, modifications and alterations may be made without departing from the spirit and scope of this invention and are understood by those skilled in the art to be included within the present invention in accordance with these specifications, drawings and claims.

What is claimed is:

1. A shoulder-supported package and article carrier comprising a carrier vest of unitary construction having dual, substantially L-shaped carrier bags disposed to each side of the wearer's torso;

adjustable vest waist belt attached to the front of said carrier bags;

padded vest collar portion providing neck comfort means wherein said vest collar portion comprises a double-layered member having a rear collar layer and a front collar layer, the width of said rear collar layer extending beyond said front collar layer, said rear collar layer being formed of a moisture absorbent material, said front collar layer being formed of a solid elastic substance covered by cloth material to provide neck comfort means by resilient support of the neck of the wearer, said double-layered member construction providing means for alternative disposition of said vest collar to provide a collared or collarless appearance; and a flexible vest back portion comprising a cross-hatched array of flexible material.

2. A shoulder-supported package and article carrier comprising a carrier vest of unitary construction having dual, substantially L-shaped carrier bags disposed to each side of the user's torso, said dual carrier bags being composed of flaccid material, each having a selectively closeable opening formed therein and integrally constructed, substantially flat bottom portion composed of flexible material capable of stretching both vertically and horizontally within the plane of said bottom portion, said dual carrier bags having pocket attachment means integrally constructed on the outer side wall of said dual carrier bags, and supplemental closure means respectively attached to the outer side wall of one carrier bag and to the inner side wall of the opposite carrier bag for cooperable engagement of said closure means;

an adjustable vest waist belt attached to the front of said carrier bags, said vest waist belt comprising two belt portions, a belt clip receipt portion and belt clip portion, each belt portion being fixedly attached at one end to a distinct carrier bag, the free end of said belt clip receipt portion having a clip receptacle attached thereto and the free end of said belt clip portion having a clip attached thereto, said clip receptacle being adjustably attached to said belt clip receipt portion for adjustment of the length of belt clip receipt portion thereby providing adjustment for said vest waist belt;

a vest collar portion comprising a double-layered member having a rear collar layer and front collar layer, the width of said rear collar layer extending beyond said front collar layer, said front collar layer being formed of a solid elastic substance covered by cloth material to provide neck comfort means by resilient support of the neck of the user;

a cross-hatched vest back portion providing flexible fitting means and back ventilation means, said vest back portion having a central portion attached at its upper edge to the substantially middle portion of said rear collar layer and at its vertical side edges to adjustment strips, said adjustment strips being preferably constructed of similar flexible material as the bottom portions of said carrier bags, said vest back portion further including peripheral portions extending from each adjustment strip to the vertical midline of the rear walls of said carrier bags; and removable and closeable pocket attachable to said pocket attachment means by cooperable engagement of pocket attachment clip and said pocket attachment means, said pocket attachment clip being disposed on the rear surface of the pocket base, said pocket including pocket closure means disposed proximate to the mouth of said pocket along the side walls of said pocket, said pocket side walls being formed in a manner to collapse along a fold-line to permit selective closing of said pocket by cooperable engagement of said pocket closure means.

* * * * *